US005613345A

United States Patent [19]

Saito et al.

[11] Patent Number: 5,613,345

[45] Date of Patent: Mar. 25, 1997

[54] WASTE DISPOSING SYSTEM AND APPARATUS

[75] Inventors: Yoshiko Saito, Tokyo; Teruyuki Fujita, Ishikawa; Tomoo Iijima, Tokyo, all of Japan

[73] Assignees: Cattleya Music Co., Ltd., Tokyo; Fuji Machinery Co., Ltd., Ishikawa-ken; North Corporation, Tokyo, all of Japan

[21] Appl. No.: 562,489

[22] Filed: Nov. 30, 1995

Related U.S. Application Data

[62] Division of Ser. No. 226,627, Apr. 12, 1994, abandoned.

[30] Foreign Application Priority Data

Dec. 29, 1993 [JP] Japan ..... 5-075790 U
Dec. 29, 1993 [JP] Japan ..... 5-353673

[51] Int. Cl.[6] ..... B65B 67/02; B65B 67/04; B65B 7/06; B65B 7/16

[52] U.S. Cl. ..... 53/266.1; 53/284.7; 53/373.2; 53/390

[58] Field of Search ..... 53/469, 476, 479, 53/481, 284.7, 373.2, 373.7, 390, 266.1, 449; 220/904, 908; 206/440, 37, 496, 499; 229/400, 404, 405; 383/93, 94, 95, 211, 907

[56] References Cited

U.S. PATENT DOCUMENTS

| | | | |
|---|---|---|---|
| 1,828,864 | 10/1931 | Hopkins | 53/469 |
| 2,099,412 | 11/1937 | Seidler | 229/400 X |
| 2,200,111 | 5/1940 | Bensel | 229/400 |
| 2,220,312 | 11/1940 | Barbieri | 229/400 |
| 2,673,496 | 3/1954 | Amberg et al. | 229/400 X |
| 2,761,613 | 9/1956 | Shiu | 383/907 X |
| 2,925,208 | 2/1960 | Wood | 229/404 |
| 3,041,802 | 7/1962 | Cummings et al. | 383/907 X |
| 3,272,418 | 9/1966 | Morse et al. | 229/400 |
| 3,306,002 | 2/1967 | Vogt | 53/481 X |
| 3,329,973 | 7/1967 | Bobbe | 229/400 X |
| 3,354,601 | 11/1967 | Schneider et al. | 53/469 X |
| 3,382,644 | 5/1968 | Vogt | 53/284.7 X |
| 4,229,928 | 10/1980 | Munchinger et al. | 53/469 X |
| 4,473,989 | 10/1984 | Tsutsumi et al. | 53/284.7 X |
| 4,608,803 | 9/1986 | Araki | 53/284.7 X |
| 4,614,073 | 9/1986 | Argazzi | 53/481 X |
| 4,813,208 | 3/1989 | Piltz et al. | 53/449 |
| 5,144,788 | 9/1992 | Varlet | 53/479 X |
| 5,350,240 | 9/1994 | Billman et al. | 383/94 X |

*Primary Examiner*—Horace M. Culver
*Attorney, Agent, or Firm*—Sughrue, Mion, Zinn, Macpeak & Seas

[57] ABSTRACT

A waste disposing system and apparatus are described which use inverted conical frustum cup-like containers of paper or synthetic resin with brims having an adhesive applied thereto, said apparatus comprising: a container supplying means for holding a stack of containers having a top and a bottom, and formed by one sliding over another, and releasing, in response to a request, one after another, from the stack of containers, permitting the falling of a sequential container that has descended down to the bottom of the stack for its turn; a standby means for holding the container with the open side thereof up, thereby permitting the filling of waste into container on standby; a sealing means for pressing the top circumference of the container which is filled with waste to seal the container; and a carrier means for transporting containers from the container supplying means to the standby means, and from the standby means to the sealing means. The waste disposing system and apparatus facilitate automatization of perfect sealing of waste-filled containers and provides for efficient disposal of unsanitary waste matter.

13 Claims, 3 Drawing Sheets

WASTE DISPOSING SYSTEM AND APPARATUS

This is a Divisional of application Ser. No. 08/226,627 filed Apr. 12, 1994, now abandoned.

BACKGROUND OF THE INVENTION

Field of the Invention

The present invention relates to a waste disposing apparatus. Diapers and menstrual paper or the like for cleaning the woman's body when waste matter has been passed from it are often thrown away in garbage boxes. Such waste matters when thrown away like ordinary rubbish are likely to cause unpleasant smells and sanitary troubles particularly in schools, hospitals, hotels, restaurants, department stores and other public buildings. Such situation requires improvement for sanitary reasons particularly from the recent tendency of increasing social concerns in AIDS.

Use of paper bags to put waste matters in has been proposed, but there are some problems in handling and sealing such paper bags by hand. Therefore, paper bags have not been popularly used for the purpose. Machines for automatically sealing such paper bags when designed, were found to be complicated and too large to be installed in toilet booths.

Assume that a waste disposing apparatus which is small enough to be installed in a toilet booth is designed and actually made, and that such disposers are installed in a plurality of toilet booths as for instance in a school. Collection of insanitary waste matters from all toilet booths, however, is very inconvenient.

SUMMARY OF THE INVENTION

One object of the present invention is to provide a disposable container for waste matters which is very convenient, and can improve the public sanitary condition.

The other object of the present invention is to provide a waste disposing apparatus which is simple in structure and small in size, facilitating the placement of waste matters in containers and the sealing of such waste-filled containers, and to provide a disposing apparatus having at least one of the waste disposing apparatus.

To attain this and other objects according to the present invention, a disposable container for treating waste matters comprising an inverted conical frustum, cup-like container body of paper or synthetic resin with its brim having an adhesive applied thereto.

The container body is a waterproof container body. The container body size is determined as appropriate for waste amount to be disposed, and the top, largest diameter of the container is selected to be within the range from 1.1 to 1.4 times of the bottom, smallest diameter of the container. The container body has a top edge curled to form a thick circumference.

A waste disposing apparatus according to the present invention uses the container, and comprises a container supplying means for holding a stack of containers by one sliding over another and releasing, in response to a request, one after another from the stack of containers, permitting the falling of a sequential container when descending down to the bottom of the stack for its turn; a standby means for holding the container with its opening side up, thereby permitting the throwing of waste into the container on standby; a sealing means for pressing the top circumference of the container which is filled with waste to seal the container; and a carrier means for transporting containers from the container supplying means to the standby means, and from the standby means to the sealing means.

The waste disposing apparatus further comprises detecting means for detecting that the container on standby has been filled with waste; and a control responsive to a signal from the detecting means for: making the carrier means to transport the waste-filled container from the standby station to the sealing means for pressing the top circumference of the waste-filled container, and throwing the sealed container away; moving the carrier to a predetermined position under the container supplying means, and stopping there; permitting the falling of a sequential container on the carrier from the stack of containers at request; and finally making the carrier means to transport the empty container to the standby station.

A waste disposing system according to the present invention comprises: at least one waste disposing apparatus using inverted conical frustum, cup-like containers of paper or synthetic resin with their brims having an adhesive applied thereto, said waste disposing apparatus comprising: a container supplying means for holding a stack of containers by one sliding over another and releasing, in response to a request, one after another from the stack of containers, permitting the falling of a sequential container when descending down to the bottom of the stack for its turn; a standby means for holding the container with its opening side up, thereby permitting the throwing of waste into the container on standby; a sealing means for pressing the top circumference of the container which is filled with waste to seal the container; and a carrier means for transporting containers from the container supplying means to the standby means, and from the standby means to the sealing means; and a vacuum transport means connected to said waste disposing apparatus for drawing up and transporting the sealed containers in air from said sealing means to a remote waste collection site.

The vacuum transport means may be connected to a plurality of waste disposing apparatuses to collect and transport all sealed containers from the waste disposing apparatuses to a common waste collection site.

The waste disposing apparatus may comprise detecting means for detecting that the container on standby has been filled with waste; and a control responsive to a signal from the detecting means for: making the carrier means to transport the waste-filled container from the standby station to the sealing means for pressing the top circumference of the waste-filled container, and throwing the sealed container away; moving the carrier to a predetermined position under the container supplying means, and stopping there; permitting the falling of a sequential container on the carrier from the stack of containers at request; and finally making the carrier means to transport the empty container to the standby station.

The control may be responsive to a signal from the detecting means for starting the vacuum transport means.

The containers may be waterproof containers. The container size may be determined as appropriate for waste amount to be disposed, and the top, largest diameter of the container is selected to be within the range from 1.1 to 1.4 times of the bottom, smallest diameter of the container.

Each container may have a top edge curled to form a thick circumference.

With this arrangement used dispers and menstrual paper or articles are thrown away in containers, and then such containers are sealed automatically without using the hands, thus assuring the sanitary condition guaranteed free of leakage of insanitary liquid and unpleasing smell. Also, the sealed containers are drawn up in air and transported to a waste collection site.

Other objects and advantages of the present invention will be understood from the following description of a waste disposing apparatus according to one embodiment of the present invention, which is shown in accompanying drawings.

DESCRIPTION OF THE PREFERRED EMBODIMENTS

Figure 1:
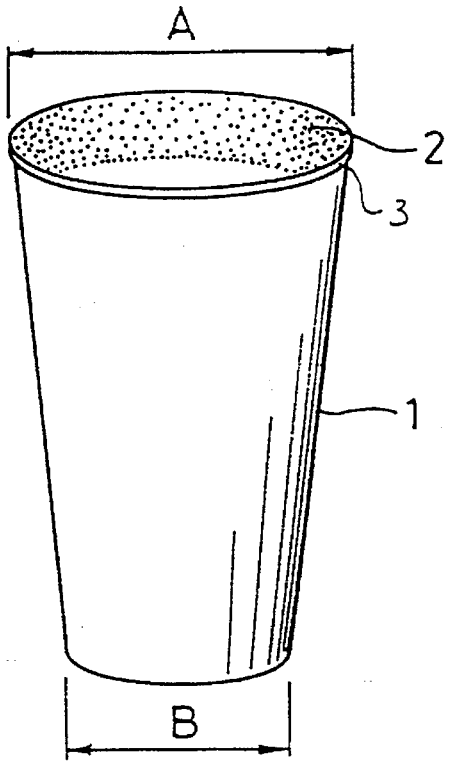
FIG. 1 is a perspective view of a disposable container to be used in the waste disposing apparatus.
Figure 2:
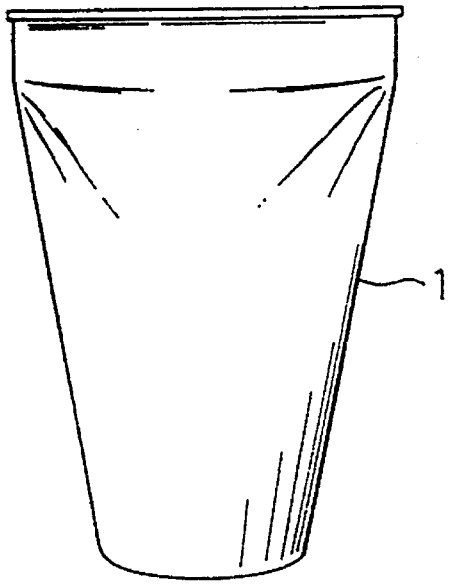
FIG. 2 is a perspective view of the disposable container after being sealed.

Referring to FIGS. 1 and 2, a disposable container 1 to be used in the waste disposing apparatus has an inverted conical frustum, cup-like shape, and is made of paper or synthetic resin. Paper includes natural paper made of natural filaments, and synthetic paper. The container comprises a circumferential wall and a bottom, opening at its top. As described later, the top edge of the container 1 is collapsed to be sealed, and therefore, it may be made of any materials other than described, provided that the material facilitates the collapsing of the top edge of the container without causing tears. Preferably each container may have a top edge 3 curled to form a thick circumference.

The container size is determined as appropriate for the amount of waste matter to be disposed, specifically the size of a disper or a menstrual paper or article. Preferably the top, largest diameter A of the container may be selected to be within the range from 1.1 to 1.4 times of the bottom, smallest diameter B of the container. When the container whose top diameter A is larger than the upper limit of the prescribed range is collapsed, the collapsed top edge will be so large as to be inconvenient in throwing away in a garbage can. Also, the collapsed container has an unpleasing shape. Containers whose top diameter A is smaller than the lower limit of the prescribed range are difficult to be stacked by one sliding over another, thus requiring a relatively large storing space.

Containers are used for containing wet waste matter, and therefore, waterproof, waxed paper containers are preferably used.

As seen from FIG. 1, the container has an adhesive 2 applied to its brim. Preferably such an adhesive 2 is a coldseal adhesive, the layer of which adhesive can stick to a same adhesive layer, but cannot stick to anything other than the same adhesive layer. One example of such adhesive is BOND CR600 (trade name) produced by Konishi K.K. Heat-sensitive adhesive or a resin of relatively low melting point may be equally used. These adhesives when applied to the brims of containers assure good sealing of containers, still permitting containers to be stacked by one sliding over another for storage.

Figure 3:
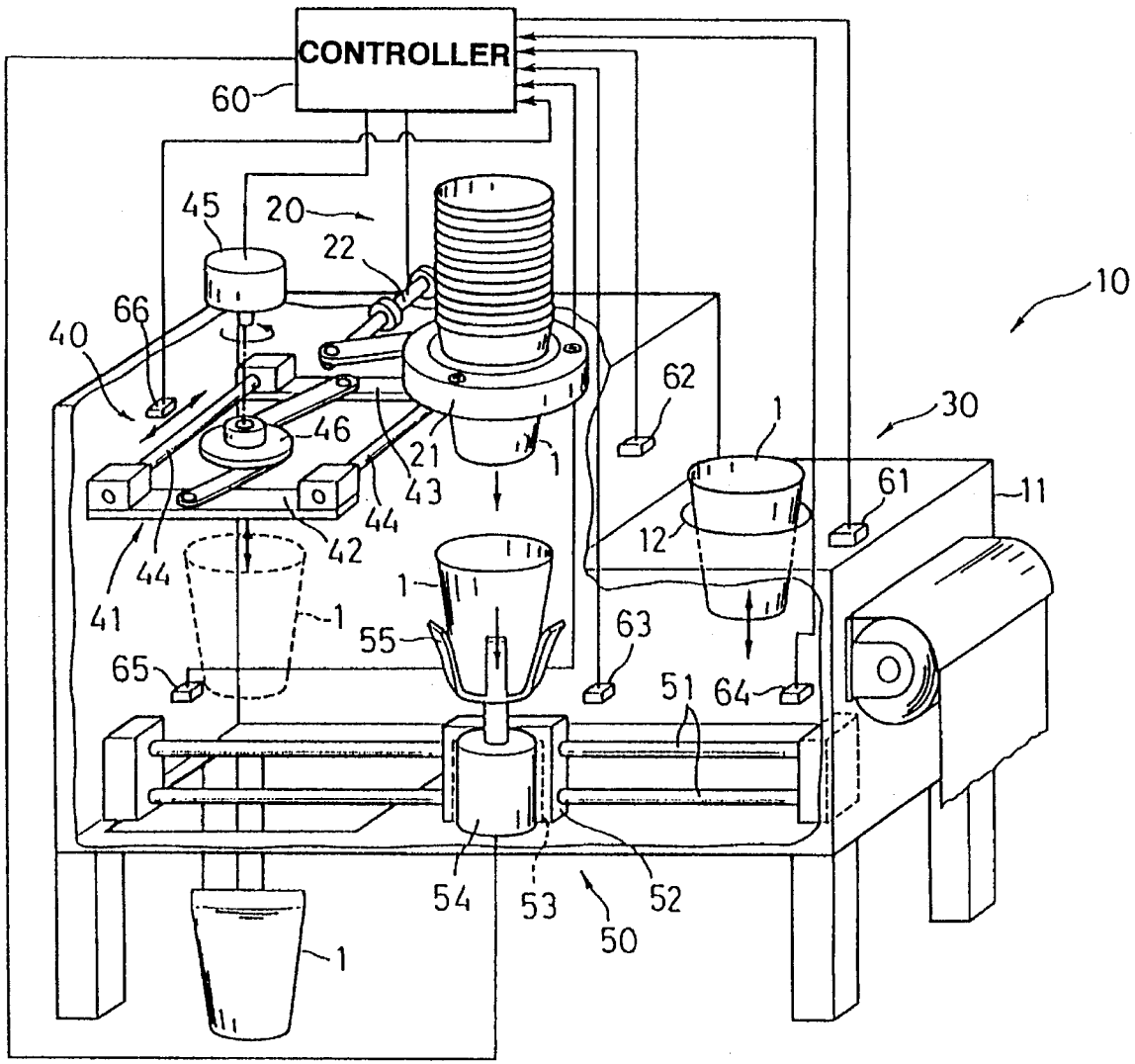
FIG. 3 is a perspective view of a waste disposing apparatus according to the present invention.

Referring to FIG. 3, the waste disposing apparatus 10 comprises, in its housing 11, a container supplying means 20, a standby means 30, a sealing means 40 and a carrier means 50.

The container supplying means 20 comprises a container supplying unit 21 which is equipped with an actuator 22, and is designed to hold a stack of containers by one sliding over another and release one after another from the stack of containers when the actuator 22 is actuated, permitting the falling of a sequential container when descending down to the bottom of the stack for its turn. The container supplying unit 21 and associated actuator 22 are the same ones as used in a paper-cup dispenser, and need not be described in detail. Disposable containers are stored in the housing 11 although not shown in FIG. 3.

The standby means 30 holds the container 1 with its opening side up, allowing it to appear partly from the circular opening 12 of the housing 11, thus permitting the throwing of waste into the container on standby, as seen from FIG. 3. The circular opening 12 is, therefore, somewhat larger in diameter than the upper opening of the container.

The sealing means 40 for pressing and sealing the top circumference of the waste-filled container comprises a sealing unit 41 having a pair of parallel board strips 42 and 43, which can be moved along opposite guide rods 44 and 44 toward and apart from each other by associated actuator 46 and drive unit 45. When containers have a heat-sensitive adhesive applied to their brims, the parallel board strips 42 and 43 have heating coils inside, thereby permitting them to function as heating-and-pressing means.

In operation a waste-filled container 1 is brought to the sealing unit 41, staying there with its top edge remaining in the space defined by the parallel board strips 42 and 43, which are laid apart from each other. Then, the drive unit 45 is energized to put the actuator 46 in motion, thereby causing the parallel board strips 42 and 43 to move toward each other to press the top edge of the waste-filled container 1. After sealing the waste-filled container 1, the parallel board strips 42 and 43 move apart from each other to release the sealed container 1, allowing it to fall down in a garbage can.

The standby means 30 and the sealing means 40 are placed on the opposite sides of the container supplying means 20.

The carrier means 50 is designed to transport containers from the container supplying means 20 to the standby means 30, and from the standby means 30 to the sealing means 40. The carrier means 50 comprises elongated guide rods 51 extending under and between the standby means 30 and the sealing means 40, and a selfdriven container carrier 52 movable along the elongated guide rods 51. The self-driven container carrier 52 is equipped with a drive means 53 and a lift means 54, which has divergent fingers 55 for receiving the container falling from the container supplying means 20.

Figure 4:
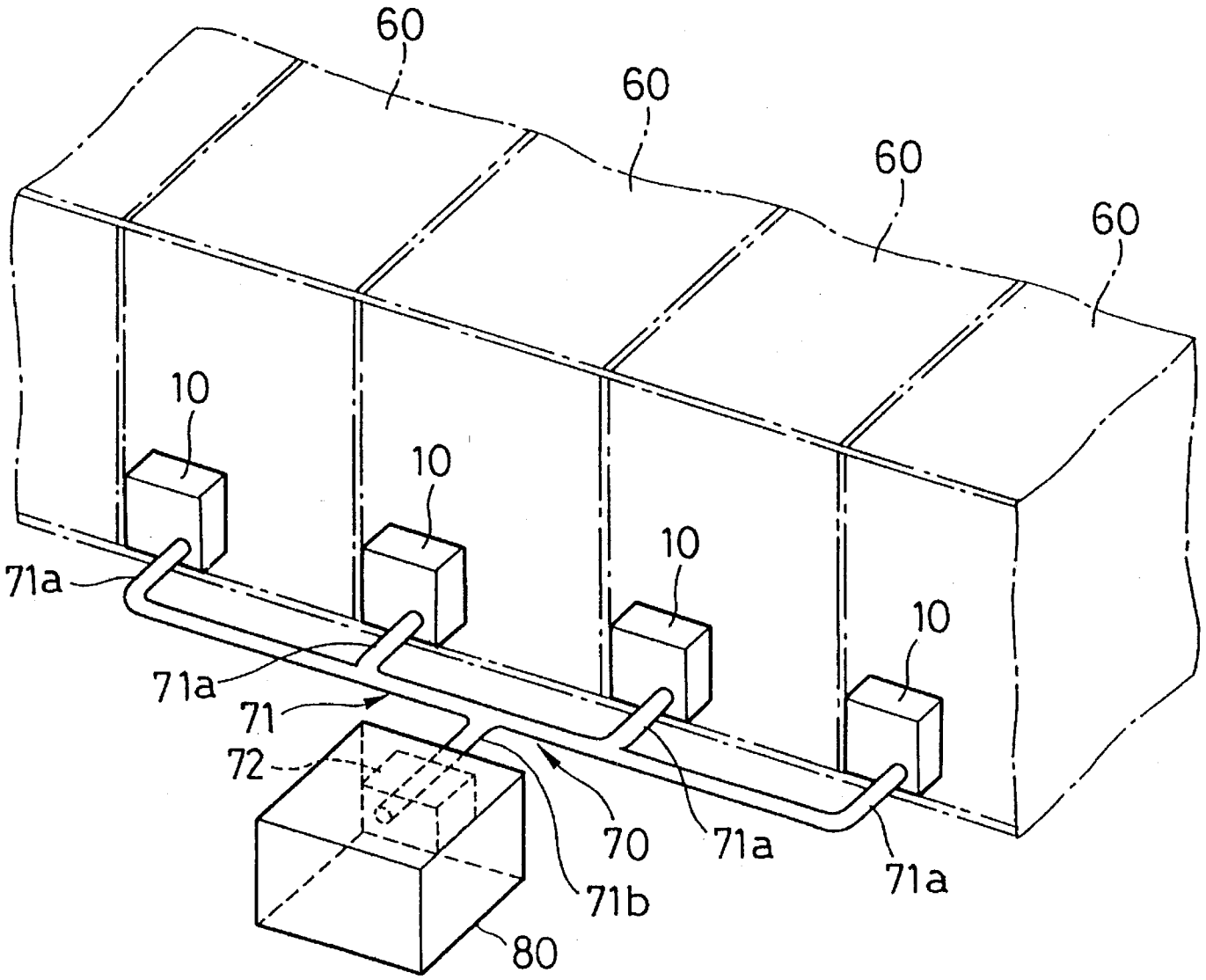
FIG. 4 is a perspective view of a waste disposing system comprising a plurality of waste disposers each installed in a toilet booth and connected to a vacuum transport means according to the present invention.

As shown in FIG. 4, a plurality of waste disposers 10 may be installed in the corresponding plurality of toilet booths, for instance in a school, and are connected to a remote waste collection site 80 via a vacuum transport means 70. The waste collection site 80 may be located in the building or apart from the building.

The vacuum transport means 70 comprises a vacuum unit 72 and a transport passage 71 comprising a plurality of branch tubes **71*a* each connected to a selected toilet booth 60 and a collection tube 71*b* connected to these branch tubes 71*a* and the vacuum unit 72. Each branch tube 71*a* has a divergent end to receive sealed containers 1 when released from the sealing means 40 of the waste disposing apparatus 10, and the sealed containers are drawn up in air to be transported to the waste collection site 80 via the transport passage 71**.

All actuators and drives in the waste disposing apparatus may use electric motors, or hydraulic or pneumatic cylinders, and may be automatically controlled by a controller 60 using a microcomputer.

The controller 60 in the waste disposing apparatus performs the controlling of a container 1 in response to different signals from a sensor 61 for detecting the presence of the container 1 at the standby stage, a sensor 62 for detecting that the container 1 on standby has been filled with waste, a sensor 63 for detecting the presence of the self-driven container carrier 52 under the container supplying means 20, a sensor 64 for detecting the presence of the selfdriven container carrier 52 under the standby means 30, a sensor 65 for detecting the presence of the self-driven container carrier 52 under the sealing means 40, a sensor 66 for detecting the appearance of the top edge 41 of the container 1 between the opposite board strips 42 and 43 and other sensors although not shown in the drawing. These sensors may be optical sensors or weight-sensitive sensors, and may be replaced by limit switches or position detectors for detecting arrival of an object at its limit.

The operation of the waste disposing apparatus 10 under the control of the controller 60 is described below.

Assume that a container 1 is put in the standby position 30 where the container 1 is held by the divergent fingers 55, which are raised by the lift means 54. When waste matter is thrown in the container, the sensor 62 detects that the container is filled with the waste, sending a signal to the controller 60. In response to the signal the controller 60 permits the lowering of the divergent fingers 55 and hence, the waste-filled container, and subsequently the energizing of the drive means 53 to move the self-driven container carrier 52 leftward along the guide rods 51. When the selfdriven container carrier 52 comes under the sealing position 40, the detector 65 detects the presence of the waste-filled container at the sealing position to send a signal to the controller 60. Then, the controller 60 stops the energizing of the drive means 53 to stop the self-driven container carrier 52, and at the same time, the controller 60 permits the energizing of the lift means 54 to raise the waste-filled container 1. When the top edge of the waste-filled container 1 enters between the opposite board strips 42 and 43, the sensor 66 sends a signal to the controller 60. In response to the signal the controller 60 permits the energizing of the drive unit 45 for putting the actuator 46 in motion, thereby causing the parallel board strips 42 and 43 to move toward each other to press the top edge of the waste-filled container 1. On the other hand the drive means 53 is energized to move the self-driven container carrier 52 rightward along the guide rods 51. After sealing the top edge of the waste-filled container it is released from the sealing means 40, thereby allowing it to fall down.

When the self-driven container carrier 52 moves rightward to come under the container supplying means 20, the sensor 63 detects the arrival of the carrier at the container supplying spot to send a signal to the controller 60, which stops the drive means 53 to allow the carrier 52 to stay there. At the same time the controller 60 puts the actuator 22 in motion, thereby permitting the container supplying unit 21 to release one container from the stack of containers, thus allowing it to fall down.

The container 1 falls on the carrier 52 to be caught by the divergent fingers 55. The drive means 53 is energized to move the self-driven container carrier 52 rightward along the guide rods 51 to come under the standby means 30, the sensor 64 detects the arrival of the carrier at the standby spot to send a signal to the controller 60, which stops the drive means 53 to allow the carrier 52 to stay there. Then, the lift 54 rises until the container 1 is put in the standby position. When the sensor 61 detects the container 1 on standby, the whole apparatus remains standstill. When the sensor 61 detects no container 1 on standby, the self-driven container carrier 52 is allowed to return to the container supplying means 20 to receive one container 1.

The controller 60 is operatively connected to the vacuum transport means 70. The controller 60 may be responsive to a signal from the sensor 62 representing the filling of waste matter in a container at the standby station for starting the vacuum transport means 70, or may be responsive to a signal from a sensor detecting the releasing of a sealed container 1 from the sealing station 40 or to a signal from a sensor detecting receipt of a sealed container by the divergent end of the branch tube 71*a* for starting the vacuum transport means 70. Preferably the vacuum transport means 70 may be made to stop automatically in a predetermined time long enough for sealed containers to pass through the transport passage 71 to the waste collection site 80. Alternatively the vacuum transport means 70 may be made to stop automatically when no containers are detected in the transport passage 71.

As is apparent from the above, the waste disposing apparatus according to the present invention can seal waste-filled containers without fail, thereby permitting the disposing of waste in sanitary condition. Also, the waste-filled containers can be automatically collected from a plurality of toilet booths to be transported to a waste collection site apart from the building. Installation of waste disposing apparatuses in toilet booths for public use, therefore, will improve the public sanitary condition.

What is claimed is:

1. A waste disposing apparatus using inverted conical frustum cup-like containers of paper or synthetic resin with brims having an adhesive applied thereto, said apparatus comprising a container supplying means for holding a stack of containers having a top and a bottom, and formed by one sliding over another, and releasing, in response to a request, one after another, from the stack of containers, permitting the falling of a sequential container that has descended down to the bottom of the stack for its turn;

a standby means for holding the container with the open side thereof up, thereby permitting the filling of waste into container on standby;

a sealing means for pressing the top circumference of the container which is filled with waste to seal the container; and a carrier means for transporting containers from the container supplying means to the standby means, and from the standby means to the sealing means.

2. A waste disposing apparatus according to claim 1 further comprising:

detecting means for detecting that the container on standby has been filled with waste; and a control responsive to a signal from the detecting means for:

making the carrier means transport the waste-filled container from the standby station to the sealing means for pressing the top circumference of the waste-filled container, and disposing of the sealed container;

moving the carrier to a predetermined position under the container supplying means, and stopping there;

permitting the falling of a sequential container at the bottom of the stack of containers onto the carrier means at request; and finally making the carrier means transport the empty container to the standby station.

3. A waste disposing system comprising;

at least one waste disposing apparatus using inverted conical frustum cup-like containers of paper or synthetic resin with brims having an adhesive applied thereto, said waste disposing system comprising:

a container supplying means for holding a stack of containers having a top and a bottom, and formed by one sliding over another, and releasing, in response to a request, one after another, from the stack of containers, permitting the falling of a sequential container that has descended down to the bottom of the stack for its turn;

a standby means for holding the container with its opening side up, thereby permitting the filling of waste into the container on standby;

a sealing means for pressing the top circumference of the container which is filled with waste to seal the container; and a carrier means for transporting containers from the container supplying means to the standby means, and from the standby means to the sealing means; and a vacuum transport means connected to said waste disposing apparatus for drawing up and transporting the sealed containers in air from said sealing means to a waste collection site.

4. A waste disposing system according to claim 3 wherein said vacuum transport means is connected to a plurality of waste disposing apparatus to collect and transport all sealed containers from said plurality of waste disposing apparatus to a common waste collection site.

5. A waste disposing system according to claim 4 further comprising:

a detecting means for detecting that the container on standby has been filled with waste; and a control responsive to a signal from the detecting means for:

making the carrier means transport the waste-filled container from the standby station to the sealing means for pressing the top circumference of the waste-filled container, and disposing of the sealed container;

moving the carrier to a predetermined position under the container supplying means, and stopping there;

permitting the falling of a sequential container at the bottom of the stack of containers onto the carrier means at request; and finally making the carrier means transport the empty container to the standby station.

6. A waste disposing system according to claim 5 wherein said containers are waterproof containers.

7. A waste disposing system according to claim 4 wherein said containers are waterproof containers.

8. A waste disposing system according to claim 3 further comprising:

a detecting means for detecting that the container on standby has been filled with waste; and a control responsive to a signal from the detecting means for:

making the carrier means transport the waste-filled container from the standby station to the sealing means for pressing the top circumference of the waste-filled container, and disposing of the sealed container;

moving the carrier to a predetermined position under the container supplying means, and stopping there;

permitting the falling of a sequential container at the bottom of the stack of containers onto the carrier means at request; and finally making the carrier means transport the empty container to the standby station.

9. A waste disposing system according to claim 8 wherein said control is responsive to a signal from said detecting means for starting said vacuum transport means.

10. A waste disposing system according to claim 8 wherein said containers are waterproof containers.

11. A waste disposing system according to claim 3 wherein said containers are waterproof containers.

12. A waste disposing system according to claim 3, 4, 8, 9, 11, or 5 wherein the top, largest diameter of the container is selected to be within the range from 1.1 to 1.4 times of the bottom, smallest diameter of the container.

13. A waste disposing system according to claim 3, 4, 8, 9, 11, or 5 wherein each container has a top edge curled to form a thick circumference.

* * * * *